US007903063B2

(12) United States Patent
Chung et al.

(10) Patent No.: US 7,903,063 B2
(45) Date of Patent: Mar. 8, 2011

(54) LIQUID CRYSTAL PANEL CAPABLE OF CONTROLLING VIEWING ANGLE AND LIQUID CRYSTAL DISPLAY DEVICE WITH THE SAME

(75) Inventors: In Jae Chung, Gyeonggi-do (KR); Hyung Seok Jang, Gyeonggi-do (KR); Hyun Suk Jin, Gyeonggi-do (KR); Joon Kyu Park, Gyeogi-do (KR); Sook Kyung You, Seoul (KR)

(73) Assignee: LG. Display Co., Ltd., Seoul (KR)

( * ) Notice: Subject to any disclaimer, the term of this patent is extended or adjusted under 35 U.S.C. 154(b) by 1031 days.

(21) Appl. No.: 11/454,645

(22) Filed: Jun. 15, 2006

(65) Prior Publication Data

US 2007/0152932 A1 Jul. 5, 2007

(30) Foreign Application Priority Data

Dec. 30, 2005 (KR) ..... 10-2005-0135083
Jan. 27, 2006 (KR) ..... 10-2006-0008737

(51) Int. Cl.
*G09G 3/36* (2006.01)

(52) U.S. Cl. ..... 345/87; 345/88

(58) Field of Classification Search ..... None
See application file for complete search history.

(56) References Cited

U.S. PATENT DOCUMENTS

| | | | | |
|---|---|---|---|---|
| 5,877,829 | A * | 3/1999 | Okamoto et al. | 349/74 |
| 5,936,596 | A * | 8/1999 | Yoshida et al. | 345/9 |
| 2001/0019390 | A1 * | 9/2001 | Itoh et al. | 349/130 |
| 2002/0063833 | A1 * | 5/2002 | Yoo et al. | 349/129 |
| 2003/0118183 | A1 * | 6/2003 | Struyk | 380/213 |

FOREIGN PATENT DOCUMENTS

| | | | |
|---|---|---|---|
| JP | 05-119754 | * | 5/1993 |
| JP | 06105305 | * | 4/1994 |
| WO | WO 2004006005 | * | 1/2004 |

* cited by examiner

*Primary Examiner* — Alexander Eisen
*Assistant Examiner* — Matthew Yeung
(74) *Attorney, Agent, or Firm* — Brinks Hofer Gilson & Lione

(57) ABSTRACT

Provided is a liquid crystal panel that limits a viewing angle. The liquid crystal panel includes a plurality of color pixels and a plurality of interference sub-pixels. Each of the color pixels includes red (R), green (G) and blue (B) sub-pixels. The interference sub-pixels are included in each of the color pixels and disposed on the same plane as the color pixels to control light that penetrates the liquid crystal panel and travels in side directions of the liquid crystal panel, except the front direction thereof. The viewing angle can be controlled by the interference sub-pixels. Since the interference sub-pixels and the color sub-pixels are disposed on the same plane, the thickness and weight of the liquid crystal panel do not increase. Further, it is possible to prevent the decrease of the light quantity and the degradation of the brightness.

19 Claims, 17 Drawing Sheets

LIQUID CRYSTAL PANEL CAPABLE OF CONTROLLING VIEWING ANGLE AND LIQUID CRYSTAL DISPLAY DEVICE WITH THE SAME

This application claims the benefit of Korean Patent Application No. 10-2005-0135083, filed on Dec. 30, 2005, and Korean Paten Application No. 10-2006-0008737, filed on Jan. 27, 2006, in the Korean Intellectual Property Office, the disclosure of which is incorporated herein in its entirety by reference.

BACKGROUND

1. Field

A liquid crystal panel that can control a viewing angle of an image and a liquid crystal display device (LCD) with the liquid crystal panel is provided.

2. Related Art

A liquid crystal display device (LCD) displays an image by controlling the strength of an electric field applied to a liquid crystal panel such that the quantity of light penetrating the liquid crystal panel is adjusted. The liquid crystal panel is the main component of the LCD. The liquid crystal panel uses external light to display an image, and thus has a limited viewing angle. An in-plane switching (IPS) mode that uses an horizontal electric field, a mode that uses a compensation film, and a multi-domain mode that uses a protrusion or an opening pattern on a transparent electrode are introduced to enhance the limited viewing angle of the liquid crystal panel.

Users of data terminals, for example, portable phones, personal digital assistants (PDAs) and computers desire that the displayed data is prevented from being viewed by others. To meet such a demand, an LCD used as a display device of the data terminals needs to provide a narrow viewing angle mode as well as a wide viewing angle mode.

A dual-structure liquid crystal panel has been proposed to meet the need for the multiple viewing angle mode.

FIG. 1 is a sectional view of a related art dual-structure liquid crystal panel capable of controlling a viewing angle. Referring to FIG. 1, the related art dual-structure liquid crystal panel includes a normal panel 10 and an interference panel 12 disposed on the normal panel 10. The normal panel 10 displays an image, while the interference panel 20 causes light traveling in the side directions to be interfered with. This dual-structure liquid crystal panel can change a viewing angle mode using the light interference operation of the interference panel 12.

An LCD including the dual-structure liquid crystal panel selectively drives the interference panel 12 to provide both a wide viewing angle mode and a narrow viewing angle mode. That is, the interference panel 12 is turned on or off to provide the narrow viewing angle mode or the wide viewing angle mode.

In the dual-structure liquid crystal panel, an external light must penetrate two liquid crystal layers and thus the brightness of an image is greatly reduced. Also, the dual-structure liquid crystal panel is thicker and heavier than a single-structure liquid crystal panel. Moreover, even in the narrow viewing angle mode, an image viewed from the front side, as illustrated in FIG. 2A, is also viewed dimly at the left and right sides, as illustrated in FIGS. 2B and 2C. This makes it difficult to ensure the secrecy of a user.

SUMMARY

A liquid crystal panel that can limit a viewing angle and an LCD with the same is provided.

A liquid crystal panel includes a plurality of color pixels, wherein each color pixel includes red (R), green (G) and blue (B) sub-pixels. A plurality of interference (E) sub-pixels are included in each of the color pixels and disposed on any one of the same plane and layer as the color pixels to limit light that penetrates the liquid crystal panel and travels in both side directions of the liquid crystal panel, except from the front direction thereof.

The sub-pixels included in each of the color pixels are connected to a pair of gate lines and a pair of data lines. The sub-pixels included in each of the color pixels are connected commonly to one gate line and connected respectively to four data lines.

The R, G and B sub-pixels are driven by a horizontal electric field and the interference sub-pixels may be driven by a vertical electric field.

Each of the R, G and B sub-pixels may include at least one or more band-shaped common electrodes that alternates with at least one or more band-shaped pixel electrodes. Each of the interference sub-pixels may include a plate-shaped pixel electrode and a plate-shaped common electrode that face each other.

In another embodiment, an LCD includes the above liquid crystal panel. A data driver pixel drives signals to the sub-pixels of the liquid crystal panel on a line basis. An interference data generator generates interference data to be supplied to the sub-pixels. A video data combiner adds the interference data to video data supplied to the data driver.

The interference data generator includes a memory that stores interference sub-pixel data that forms an image with an interference pattern. A memory controller that controls a read operation of the memory.

The interference data generator further include an offset sub-pixel data generator that generates offset sub-pixel data with a logic value corresponding to an offset voltage. A selector selectively transferring the offset sub-pixel data from the offset sub-pixel data generator and the interference sub-pixel data from the memory to the video data combiner in response to a wide/narrow mode control signal.

The offset sub-pixel data generator includes either a register or a switch.

The memory may further store offset sub-pixel data with a logic value corresponding to an offset voltage. The memory controller control the memory according to a wide/narrow mode control signal such that the offset sub-pixel data and the interference sub-pixel data stored in the memory are selectively read and transmitted to the video data combiner.

The interference data generator includes a data combiner that combines R, G and B sub-pixel data contained in the video data. An operation unit that calculates interference sub-pixel data on the basis of the combined sub-pixel data and supplies the calculated interference sub-pixel data to the video data combiner.

The operation unit may perform an operation such that a luminance value of the interference sub-pixel data is distributed at a reference gray scale level.

The operation unit calculates the interference sub-pixel data by setting the sum of R, G, B and E sub-pixel data with a gray scale level lower than the maximum gray scale level to a reference luminance data and subtracting the sum of the combined R, G and B sub-pixel data from the data combiner from the reference luminance data.

The operation unit includes either a processor that performs an operation on the interference sub-pixel data using the combined R, G and B sub-pixel data from the data combiner or a look-up table configured to supply the interference sub-pixel data to the video data combiner using the combined R, G and B sub-pixel data from the data combiner.

The interference data generator may further include an offset sub-pixel data generator that generates offset sub-pixel data with a logic value corresponding to an offset voltage. A selector that selectively transfers the offset sub-pixel data from the offset sub-pixel data generator and the interference sub-pixel data from the operation unit to the video data combiner in response to a wide/narrow mode control signal.

It is to be understood that both the foregoing general description and the following detailed description are exemplary and explanatory and are intended to provide explanation.

DRAWINGS

The accompanying drawings, which are included to provide a further understanding and are incorporated in and constitute a part of this application, illustrate embodiment(s) that serve to explain the principles of this application. In the drawings.

DESCRIPTION

Figure 1:
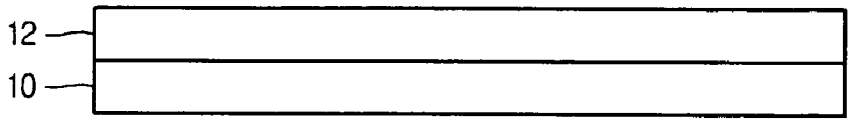
Fig. 1 (Related Art)
FIG. 1 is a sectional view of a related art liquid crystal panel capable of controlling a viewing angle.
Figure 2A:
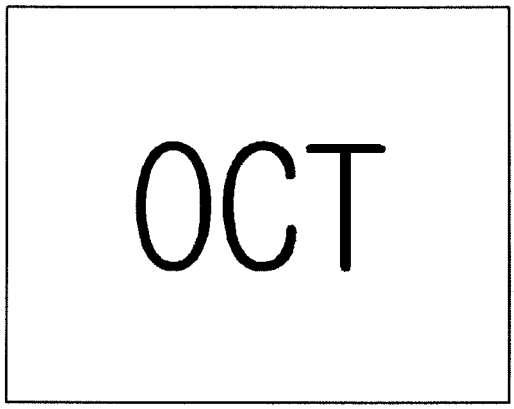
FIG. 2A (Related Art)
FIGS. 2A to 2C illustrate the states of an image depending on viewing angles when the liquid crystal panel of FIG. 1 operates in a narrow viewing angle mode.
Figure 2B:
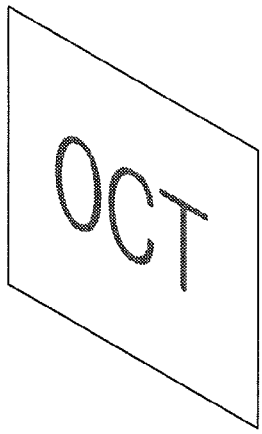
FIG. 2B (Related Art)
Figure 2C:
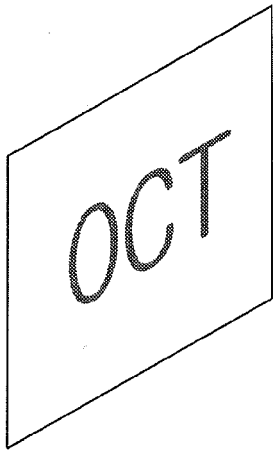
FIG. 2C (Related Art)
Figure 3:
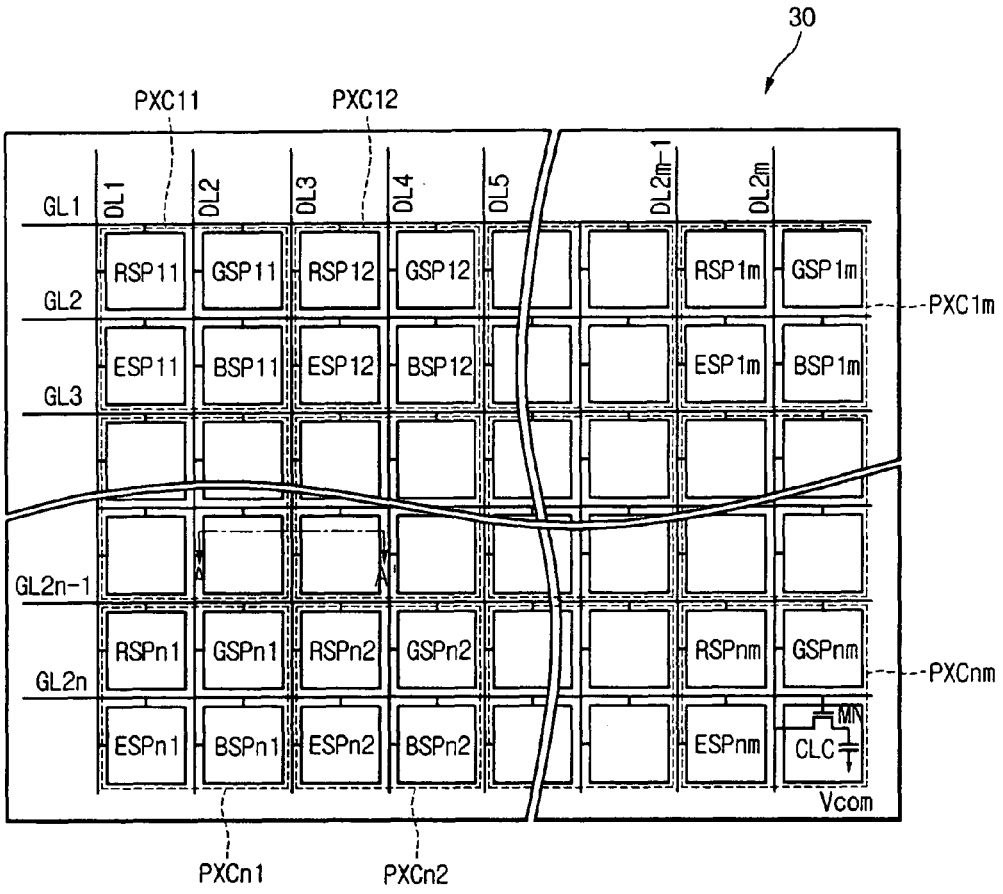
FIG. 3 is a plan view of a liquid crystal panel that limits a viewing angle.

FIG. 3 is a plan view of a liquid crystal panel that limits a viewing angle.

Referring to FIG. 3, in a liquid crystal panel 30, a plurality of sub-pixels RSP11~RSPmn, GSP11~GSPmn, BSP11~BSPmn, and ESP11~ESPmn are disposed in a plurality of regions that are divided by a plurality of horizontally-arranged data lines DL1~DL2m and a plurality of vertically-arranged gate lines GL1~GL2n. Each of the sub-pixels RSP11~RSPmn, GSP11~GSPmn, BSP11~BSPmn, and ESP11~ESPmn includes a liquid crystal cell CLC connected to a common electrode Vcom. A thin film transistor (TFT) MN that switches a sub-pixel that drives a signal transmitted from the data line DL to the liquid crystal cell CLC in response to a scan signal on a gate line GL.

The sub-pixels are classified into red (R) sub-pixels RSP11~RSPmn, green (G) sub-pixels GSP11~GSPmn, blue (B) sub-pixels BSP11~BSPmn, and interference (E) sub-pixels ESP11~ESPmn. The R sub-pixels RSP11~RSPmn are connected to the corresponding odd-numbered gate lines GL1~GL2n−1 and the corresponding odd-numbered data lines DL1~DL2m−1. The G sub-pixels GSP11~GSPmn are connected to the corresponding odd-numbered gate lines GL1~GL2n−1 and the corresponding even-numbered data lines DL2~DL2m. The B sub-pixels BSP11~BSPmn are connected to the corresponding even-numbered gate lines GL2~GL2n and the corresponding even-numbered data lines DL2~DL2m. The E sub-pixels ESP11~ESPmn are connected to the corresponding even-numbered gate lines GL2~GL2n and the corresponding odd-numbered data lines DL1~DL2n−1. In addition, the respective E sub-pixels ESP11~ESPmn are grouped together with the corresponding R, G and B sub-pixels RSP11~RSPmn, GSP11~GSPmn and BSP11~BSPmn that are adjacent to the top and right sides thereof, thereby forming color pixels PXC11~PXCmn that limit a viewing angle of an image.

The first color pixel PXC11 of a first line includes the R and G sub-pixels RSP11 and GSP11 that are connected commonly to the first gate line GL1 and connected respectively to the first and second data lines DL1 and DL2. The E and B sub-pixels ESP11 and BSP11 are connected commonly to the second gate line GL2 and connected respectively to the first and second data lines DL1 and DL2.

The last color pixel PXCmn of the last line includes the R and G sub-pixels RSPmn and GSPmn that are connected commonly to the (2n−1)th gate line GL2n−1 and connected respectively to the (2m−1)th and (2m)th data lines DL2m−1 and DL2m. The E and B sub-pixels ESPmn and BSPmn are connected commonly to the (n)th gate line GL2n and connected respectively to the (2m−1)th and (2m) data lines DL2m−1 and DL2m.

The R, G and B sub-pixels RSP11~RSPmn, GSP11~GSPmn and BSP11~BSPmn are driven in an in-plane switching (IPS) mode, such that an image is displayed at a wide viewing angle. On the contrary, the E sub-pixels ESP11~ESPmn are driven in a vertical alignment (VA) mode, such that an image to be viewed in a side direction is selectively interfered with according to an interference sub-pixel signal. An image displayed on the liquid crystal panel 30 is viewed only within the range of a small angle with respect to the front of the liquid crystal panel 30. In other words, when an image interference occurs due to the E sub-pixels ESP11~ESPmn, an image of a narrow viewing angle mode is displayed on the liquid crystal panel 30. When no image interference occurs, an image of a wide viewing angle mode is displayed on the liquid crystal panel 30.

Figure 4:
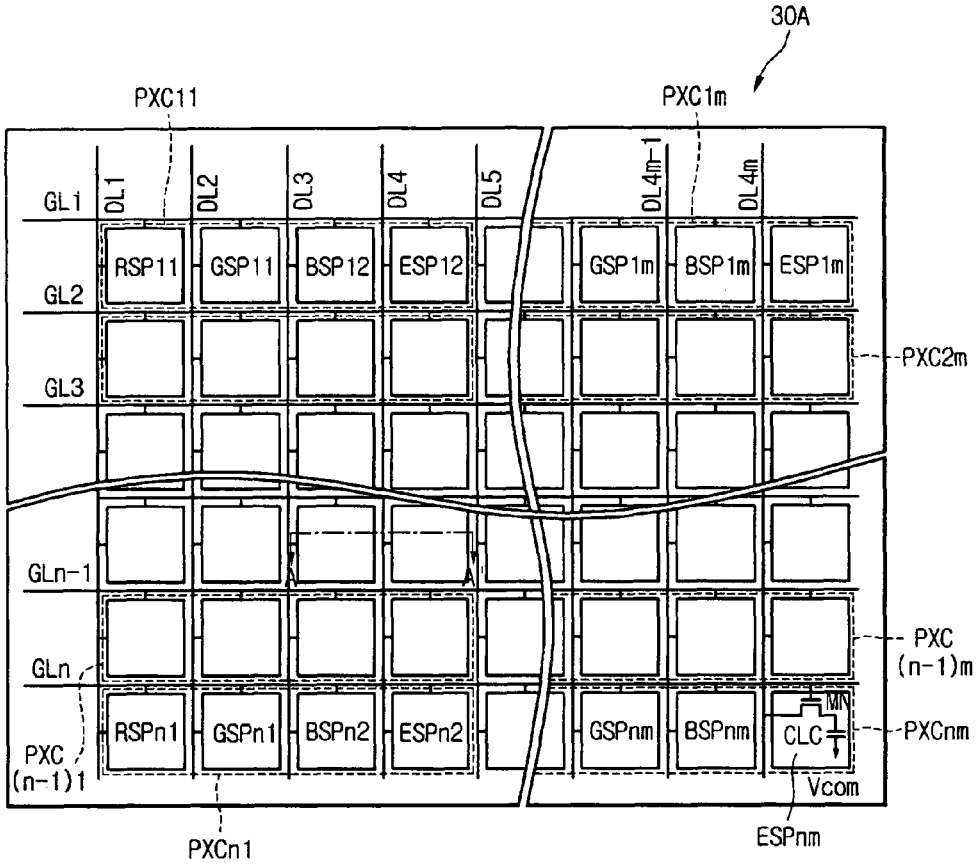
FIG. 4 is a plan view of a liquid crystal panel that limits a viewing angle according to another embodiment.

FIG. 4 is a plan view of a liquid crystal panel that limits the viewing angle according to another embodiment.

Referring to FIG. 4, in a liquid crystal panel 30A, a plurality of sub-pixels RSP11~RSPmn, GSP11~GSPmn, BSP11~BSPmn, and ESP11~ESPmn are disposed in a plurality of regions that are divided by a plurality of horizontally-arranged data lines DL1~DL4m and a plurality of vertically-arranged gate lines GL1~GLn. Each of the sub-pixels RSP11~RSPmn, GSP11~GSPmn, BSP11~BSPmn, and ESP11~ESPmn includes a liquid crystal cell CLC connected to a common electrode Vcom. A thin film transistor (TFT) MN switches a sub-pixel driving signal to be transmitted from the data line DL to the liquid crystal cell CLC in response to a scan signal on a gate line GL. The sub-pixels are classified into red (R) sub-pixels RSP11~RSPmn, green (G) sub-pixels GSP11~GSPmn, blue (B) sub-pixels BSP11~BSPmn, and interference (E) sub-pixels ESP11~ESPmn. The R sub-pixels RSP11~RSPmn are connected to the corresponding (4k−3)th data lines DL1~DL4m−1. The G sub-pixels GSP11~GSPmn are connected to the corresponding (4k−2)th data lines DL2~DL4m−2. The B sub-pixels BSP11~BSPmn are connected to the corresponding (4k−1)th data lines DL3~DL4m−1. The E sub-pixels ESP11~ESPmn are connected to the corresponding (4k)th data lines DL4~DL4m.

The respective E sub-pixels ESP11~ESPmn are grouped together with the corresponding R, G and B sub-pixels RSP11~RSPmn, GSP11~GSPmn and BSP11~BSPmn that are successively adjacent to the left side thereof, thereby forming color pixels PXC11~PXCmn that limit a viewing angle of an image. Accordingly, the first color pixel PXC11 of a first line includes the R, G, B and E sub-pixels RSP11, GSP11, BSP11 and ESP11 that are connected commonly to the first gate line GL1 and connected respectively to the first to fourth data lines DL1~DL4. The last color pixel PXCmn of the last line includes the R, G, B and E sub-pixels RSPmn, GSPmn, BSPmn and ESPmn that are connected commonly to the (n)th gate line GLn and connected respectively to the (4m−3)th to (4m)th data lines DL4m−3~DL4m.

The R, G and B sub-pixels RSP11~RSPmn, GSP11~GSPmn and BSP11~BSPmn are driven in an IPS mode, such that an image is displayed at a wide viewing angle. The E sub-pixels ESP11~ESPmn are driven in a VA mode, such that an image to be viewed in a side direction is selectively interfered with according to an interference sub-pixel signal. An image displayed on the liquid crystal panel 30A is viewed only within the range of a small angle with respect to the front of the liquid crystal panel 30A. In other words, when an image interference occurs due to the E sub-pixels ESP11~ESPmn, an image of a narrow viewing angle mode is displayed on the liquid crystal panel 30A. When no image interference occurs, an image of a wide viewing angle mode is displayed on the liquid crystal panel 30A.

Figure 5:
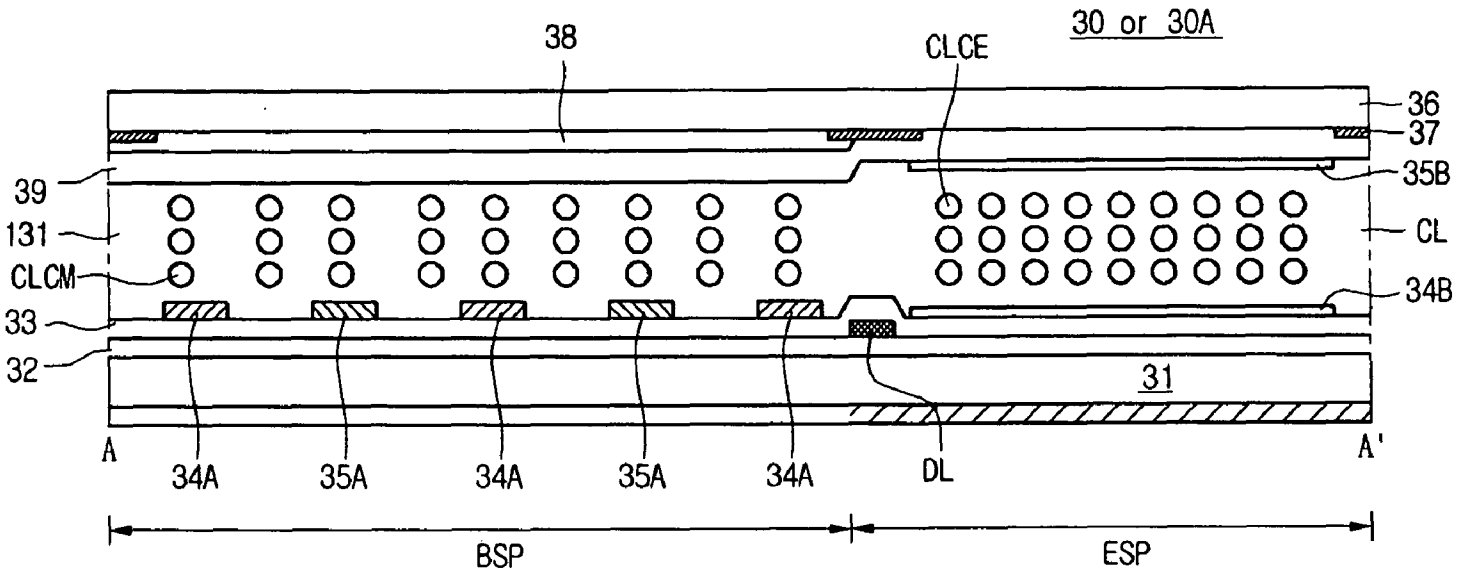
FIG. 5 is a sectional view taken along a line A-A' in FIGS. 3 and 4.

FIG. 5 is a sectional view taken along a line A-A' in FIGS. 3 and 4.

Referring to FIG. 5, the liquid crystal panels 30 or 30A includes a liquid crystal layer CL that is disposed between a lower glass layer 31 and an upper glass layer 36. A gate insulating layer 32, a data line DL and a passivation layer 33 are sequentially formed on the lower glass substrate 31. Although not illustrated, a TFT and a gate line are formed between the gate insulating layer 32 and the lower glass substrate 31. The data line DL is electrically connected through the gate insulating layer 32 to the TFT. A region located to the left of the data line DL corresponds to a blue (B) sub-pixel BSP, while a region located to the right of the data line DL corresponds to an interference (E) sub-pixel ESP. First pixel electrodes 34A and common electrodes 35A are alternately formed on the passivation layer 33 located to the left of the data line DL. A second pixel electrode 34B is formed on the passivation layer 33 located to the right of the data line DL. The first pixel electrodes 34A and the common electrodes 35A are formed, for example, in the shape of a band, while the second pixel electrode 34B is formed, for example, in the shape of a plate with the same size as a sub-pixel region.

A black matrix 37 is formed on the bottom surface of the upper glass substrate 36 to divide sub-pixel regions. A color filter 38 is formed in each of color sub-pixel regions among the sub-pixel regions divided by the black matrix 37. That is, a blue color filter is formed in a blue sub-pixel region BSP located to the left of the data line DL. An overcoat layer 39 is formed on the black matrix 37 and the color filter 38. A second common electrode 35B with the same size as a sub-pixel region is formed on the right half of the overcoat layer 39 in the region located to the right of the data region DL.

Figure 6A:
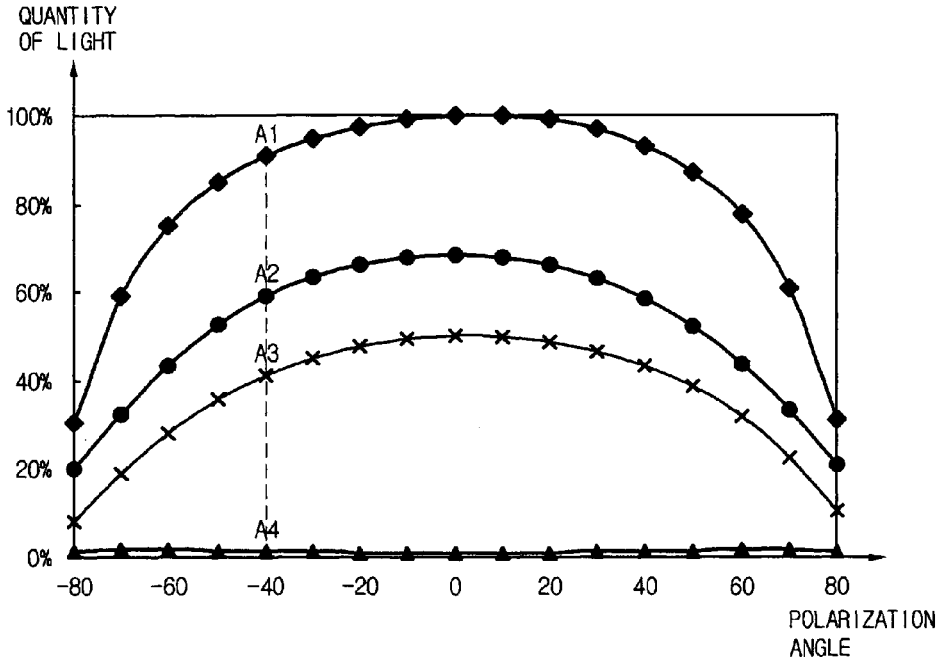
FIGS. 6A to 6C are graphs that illustrate the polarization characteristics of the liquid crystal panel in FIG. 5.

In the blue sub-pixel BSP, a horizontal electric field is applied to the liquid crystal layer CL by the first pixel electrodes 34A and the first common electrodes 35A that are alternately arranged on the lower glass substrate 31. Liquid crystal molecules CLCM in the blue sub pixel BSP, which responds to a voltage applied between the first pixel electrodes 34A and the first common electrodes 35A, polarize a penetrating light such that the quantity of light decreases as a viewing angle increases from the front to the side of the liquid crystal panel, as illustrated in FIG. 6A. An image displayed on the liquid crystal panel 30 or 30A can be viewed also in the side direction that is greatly inclined from the front direction of the liquid crystal panel. That is, the liquid crystal panel 30 or 30A displays an image of a wide viewing angle mode.

Figure 6B:
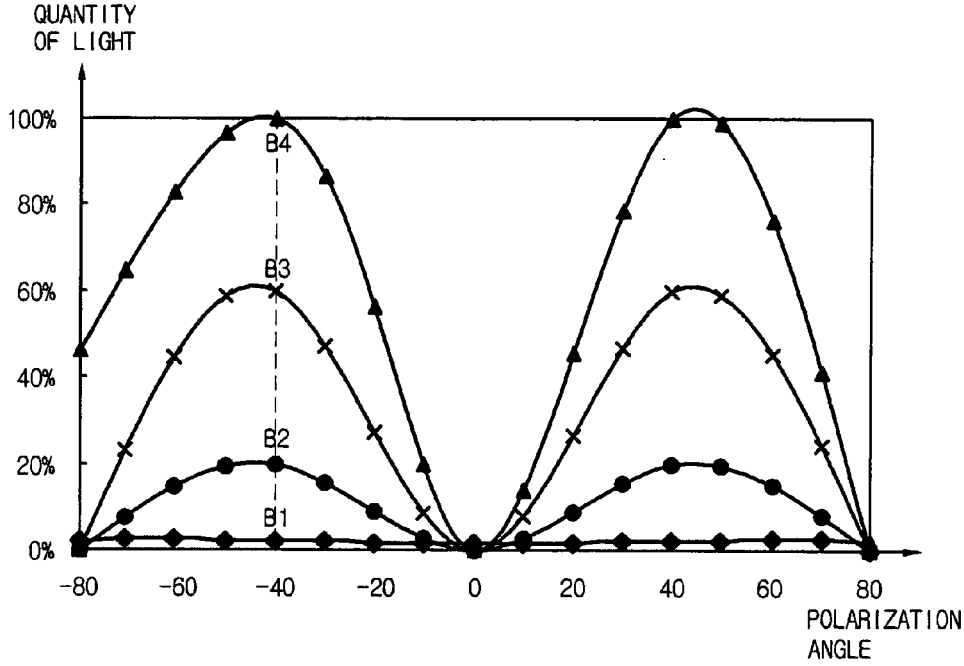
Figure 6C:
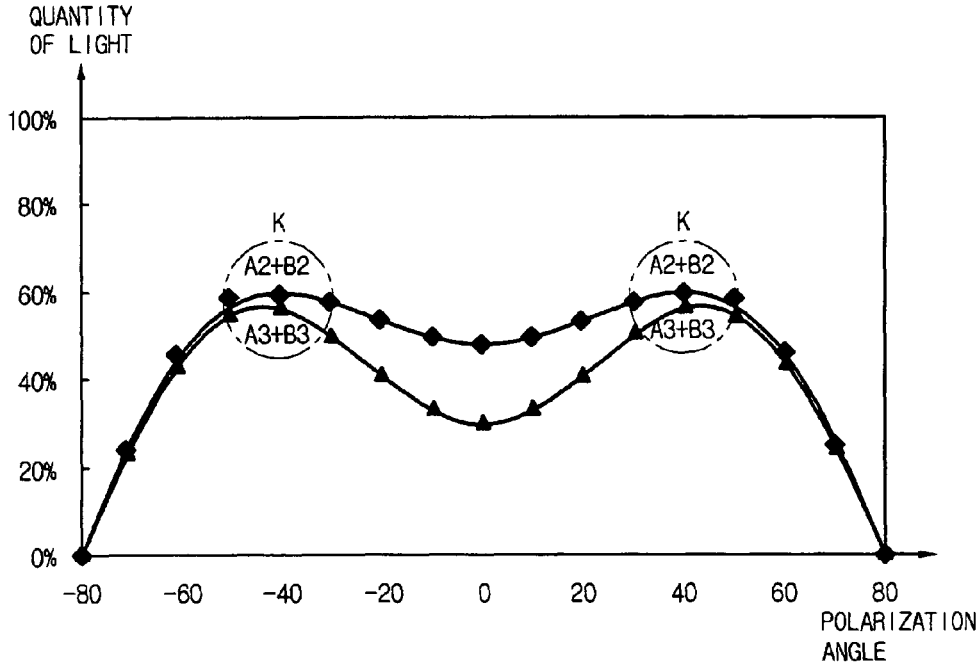

In the interference sub-pixel ESP, a vertical electric field is applied to the liquid crystal panel CL by the second pixel electrode 34B and the second common electrode 35B that are disposed respectively on the lower and upper glass substrates 31 and 36 to face each other. Liquid crystal molecules CLCE in the interference sub pixel ESP, which responds to the size of a vertical electric field applied between the second pixel electrode 34B and the second common electrode 35B, polarize light such that the quantity of light is maximized in both side directions that are inclined by about 40° with respect to the front direction of the liquid crystal panel, as illustrated in FIG. 6B. That is, the liquid crystal molecules CLCE in the interference sub-pixel ESP polarize light such that the light travels in both side directions, except the front direction. Accordingly, the liquid crystal panels 30 and 30A can control a viewing angle.

Since the interference sub-pixel ESP and the color sub-pixels RSP, GSP and BSP are disposed on the same plane or on the same layer, the thickness and weight of the liquid crystal panel do not increase. The viewing angle can be limited by only one liquid crystal layer, and the decrease of the light quantity and the degradation of the brightness can be prevented.

Figure 7:
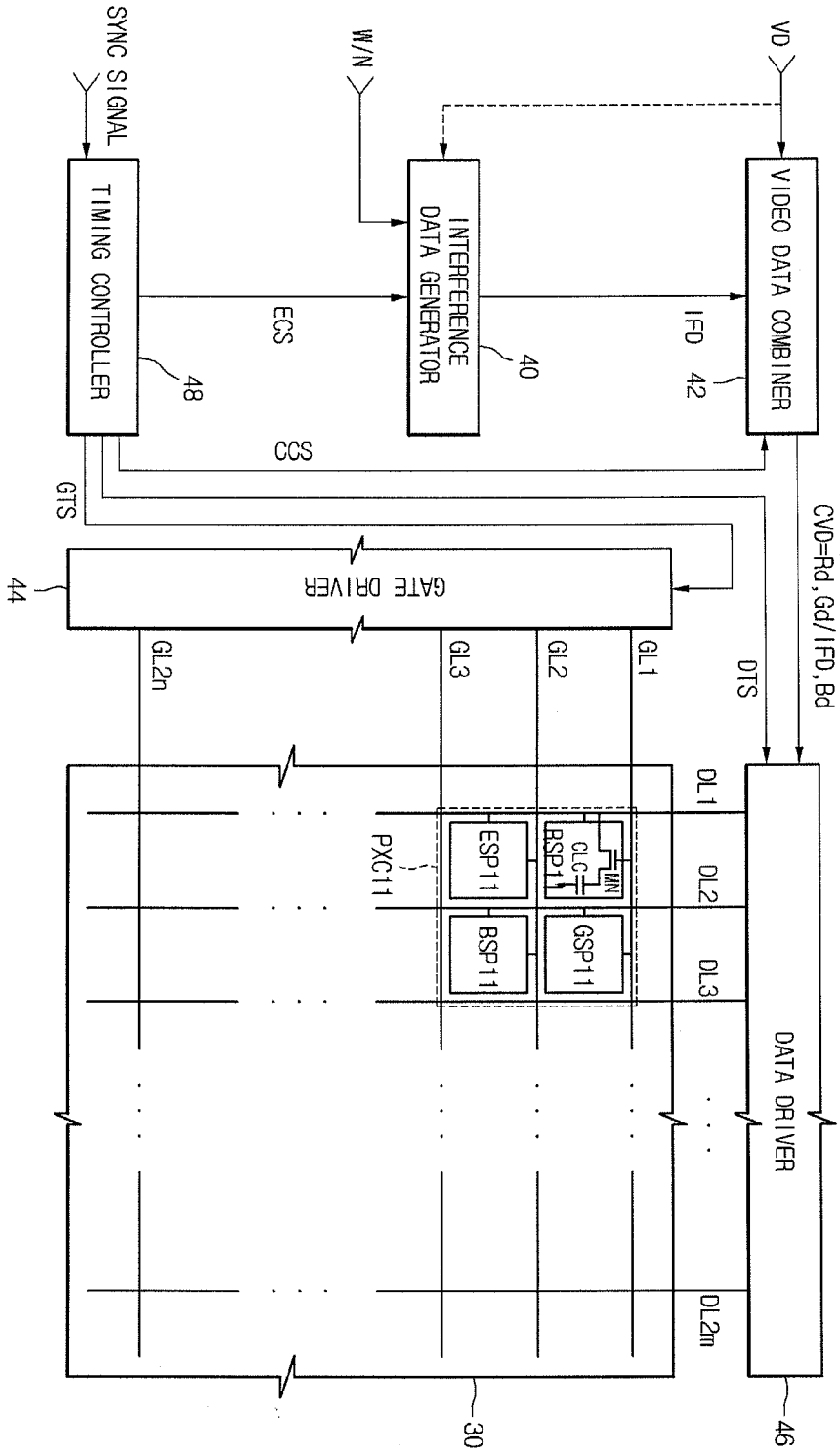
FIG. 7 is a block diagram of an LCD that limits a viewing angle.

FIG. 7 is a block diagram of an LCD that limits a viewing angle.

Referring to FIG. 7, an LCD according to another embodiment includes a liquid crystal panel 30. A interference data generator 40 generates interference data IFD to be supplied to the interference sub-pixels ESP11~ESPmn on the liquid crystal panel 30. A video data combiner 42 adds the interference data IFD to external video data VD. As illustrated in FIG. 3, the liquid crystal panel 30 includes m×n number of color pixels PXC11~PXCmn that include the red (R) sub-pixels RSP11~RSPmn connected to the odd-numbered gate lines GL1~GL2n−1 and the odd-numbered data lines DL1~DL2m−1. The green (G) sub-pixels GSP11~GSPmn are connected to the odd-numbered gate lines GL1~GL2n−1 and the even-numbered data lines DL2~DL2m. The blue (B) sub-pixels BSP11~BSPmn are connected to the even-numbered gate lines GL2~GL2n and the odd-numbered data lines DL1~DL2m−1. The interference sub-pixels ESP11~ESPmn are connected to the even-numbered gate lines GL2~GL2n and the even-numbered data lines DL2~DL2m.

In response to a wide/narrow mode control signal WIN from an external video source (e.g. a graphic card of a computer), the interference data generator 40 supplies the interference data IFD for switching W/N modes of a viewing angle of the liquid crystal panel 30 to the video data combiner 42. When the wide/narrow mode control signal W/N has a specific logic level (e.g., a "high" logic level or a "low" logic level) that designates a narrow viewing angle mode, the interference data IFD includes interference (E) sub-pixel data Ed that form an image of a fixed interference pattern, which allows interference light to be added in the both side directions with respect to the front direction of the liquid crystal panel 30. Alternatively, the interference data IFD may include interference sub-pixel data Ed that forms an interference pattern that varies per image. To generate the interference data IFD with the interference pattern that varies per image, the interference data generator 40 receives the external video data VD from the external video source (e.g., a graphic card of a computer). On the other hand, when the wide/narrow mode control signal W/N has an initialization logic level (e.g., a "low" logic level or a "high" logic level) that designates a wide viewing angle mode, the interference data IFD includes offset sub-pixel data Eoff with an offset value, which prevents interference light from traveling in the both side directions with respect to the front direction of the liquid crystal panel 30.

The video data combiner 42 receives a video data VD that includes color sub-pixel data for the R, G and B sub-pixels RSP, GSP and BSP from the external video source (not illustrated). The video data combiner 42 adds the interference data IFD from the interference data generator 40 to the video data VD. Also, the video data combiner 42 rearranges the color sub-pixel data and the interference (or offset) sub-pixel data Ed (or Eoff) in accordance with the arrangement state of the sub-pixels on the liquid crystal panel 30, thereby generating combined video data CVD. When the R and G sub-pixels RSP and GSP connected to the odd-numbered gate lines GL1~GL2n−1 are scanned, the combined video data CVD includes a sub-pixel data stream in which R and G sub-pixel data Rd and Gd alternate with each other. When the E and B sub-pixels ESP and BSP connected to the even-numbered gate lines GL2~GL2n are scanned, the combined video data CVD includes a sub-pixel data stream in which interference (or offset) and B sub-pixel data Ed (or Eoff) and Bd alternate with each other.

The LCD according to the embodiment of the present invention further includes a gate driver 44 sequentially drives the gate lines GL1~GL2n. A data driver 46 sequentially drives the data lines DL1~DL2m. A timing controller 48 controls the operation timing of the gate and data drivers 44 and 46. In response to a gate timing signal GTS from the timing controller 48, the gate driver 44 generates 2n number of scan signals that sequentially enables the gate lines GL1~GL2n.

In response to a data timing signal DTS from the timing controller 48, the data driver 46 supplies sub-pixel driving signals to the data lines DL11~LL2m every time any one of the gate lines GL1~GL2n is enabled. The data driver 46 receives the combined video data CVD that is serially transferred from the video data combiner 42. When lines of the R and G sub-pixels RSP and GSP that are connected to any one of the odd-numbered gate lines GL1~GL2n−1 are scanned, the data driver 46 receives the sub-pixel data stream in which R and G sub-pixel data Rd and Gd alternate with each other, such that an R sub-pixel driving signal and a G sub-pixel driving signal are supplied to the odd-numbered data lines DL1~DL2m−1 and the even-numbered data lines DL2~DL2m, respectively. When lines of the E and B sub-pixels ESP and BSP connected to any one of the even-numbered gate lines GL2~GL2n are scanned, the data driver 46 receives the sub-pixel data stream in which interference (or offset) and blue sub-pixel data Ed (or Eoff) and Bd alternate with each other, such that an interference sub-pixel driving signal and a blue sub-pixel driving signal are supplied to the odd-numbered data lines DL1~DL2m−1 and the even-numbered data lines DL2~DL2m, respectively.

When the wide/narrow mode control signal W/N has the specific logic level that designates the narrow viewing angle mode, the interference sub-pixel driving signal has a voltage level that allows the interference sub-pixel ESP to transmit interference light in the both side directions with respect to the front direction of the liquid crystal panel 30. The quantity of this interference light is adjusted according to the voltage level of the interference sub-pixel driving signal. This quantity of the interference light is added to the quantity of light that travels through the R, G and B sub-pixels RSP, GSP and BSP in both side directions, such that luminance components at both sides interfere with each other.

Figure 8A:
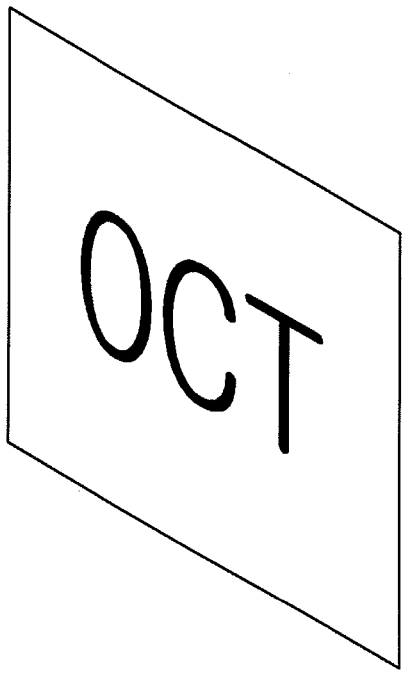
FIGS. 8A and 8B illustrate the states of an image on a liquid crystal panel of the LCD of FIG. 7, which are viewed from the side in wide and narrow viewing angle modes, respectively.
Figure 8B:
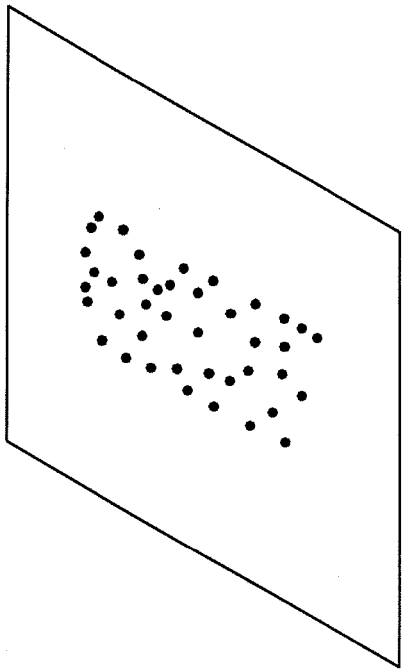

As illustrated in FIG. 8B, an image that cannot be viewed in the side direction is displayed on the liquid crystal panel 30. Also, the interference sub-pixel driving signals have different voltage levels at positions of the interference sub-pixels ESP11~ESPmn, and thus the color pixels PXC have different interference amounts of luminance. An image displayed on the liquid crystal panel 30 cannot be recognized in both side directions. Consequently, the secrecy in the narrow viewing angle mode is further enhanced.

When the wide/narrow mode control signal W/N has the initialization logic level that designates the wide viewing angle mode, the interference sub-pixel ESP responds to an offset sub-pixel driving signal with an offset voltage level that prevents interference light from traveling in the front and both side directions of the liquid crystal panel 30. Due to this offset sub-pixel driving signal, light only travels through the R, G and B sub-pixels in the front and both side directions of the liquid crystal panel 30. As illustrated in FIG. 8A, an image displayed on the liquid crystal panel 30 can be viewed in the side direction as well as the front direction.

The timing controller 48 receives sync signals (i.e., vertical and horizontal sync signals and a data clock) from the external video source. Using the sync signals, the timing controller 48 generates the gate timing signal GTS that is supplied to the gate driver 44 the data timing signal DTS that is supplied to the data driver 46. The timing controller 48 generates an interference control signal ECS that controls the data generating operation of the interference data generator 40 and a combination control signal CCS that controls the data combining operation of the video data combiner 42.

Figure 9:
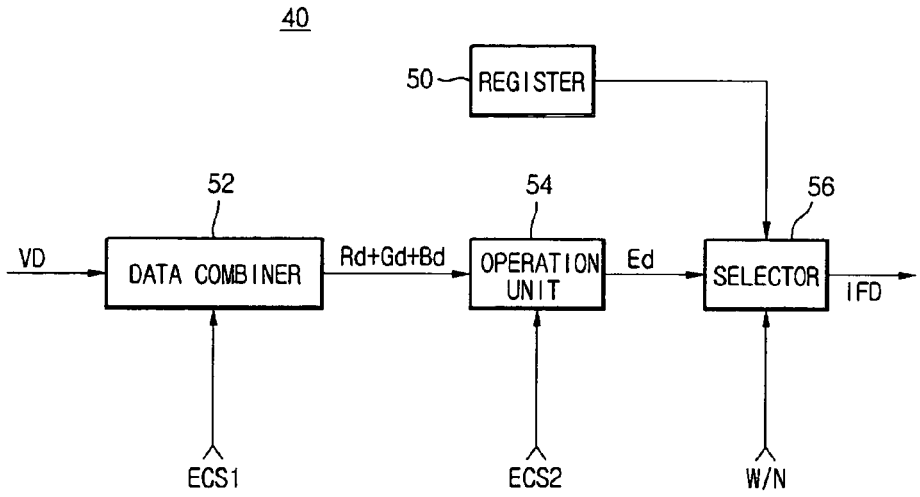
FIG. 9 is a detailed block diagram that illustrates an embodiment of an interference data generator in FIG. 7.

FIG. 9 is a detailed block diagram that illustrates an embodiment of the interference data generator 40 in FIG. 7.

Referring to FIG. 9, the interference data generator 40 includes a register 50, a data combiner 52, an operation unit 54 and a selector 56 that operate to reply sequentially to the video data VD from the external video source (i.e., a graphic card of a computer). The register 50 stores the offset sub-pixel data Eoff corresponding to an offset value. The register 50 can be replaced by a plurality of switches that can generate the offset sub-pixel data Eoff.

The data combiner 52 sequentially receives the R, G and B sub-pixel data Rd, Gd and Bd and simultaneously transfers them to the operation unit 54. The data combiner 52 responds to a first interference control signal ECS1 from the timing controller 48 of FIG. 7. The first interference control signal ECS1 is preferably a data clock having the same period as the sub-pixel data. The data combiner 52 is preferably a shift register that sequentially shifts the R, G and G sub-pixel data Rd, Gd and Bd from the external video source in response to the first interference control signal ECS1.

Figure 10A:
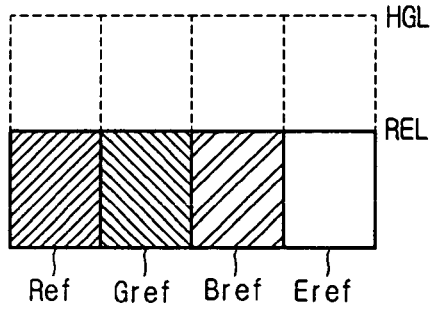
FIG. 10A illustrates the characteristics of reference luminance data used in an operation unit of FIG. 9.

Using the combined R, G and B sub-pixel data Rd, Gd and Bd from the data combiner 52, the operation unit 54 generates the interference sub-pixel data Ed. The operation unit 54 that receives the combined R, G and B sub-pixel data Rd, Gd and Bd and responds to a second interference control signal ECS2 from the timing controller 48. The second interference control signal ECS2 has ⅓ times the frequency (i.e., 3 times the period) of the first interference control signal ECS1. The second interference control signal ECS2 is preferably a ⅓-divided data clock. For calculation of the interference sub-pixel data Ed, the operation unit 54 subtracts the combined R, G and B data Rd, Gd and Bd from a reference luminance data Yd according to Equation (1) below. As illustrated in FIG. 10A, the reference luminance data Yd is determined to be the sum of R, G, B and E sub-pixel data Rref, Gref, Bref and Eref with a reference gray scale level REL that is lower than the maximum gray scale level HGL of the R, G, B and E sub-pixel data Rd, Gd, Bd and Ed. The reference gray scale level REL is preferably an intermediate gray scale level of each of the sub-pixel data.

$$Ed = Yd - (Rd + Gd + Bd) \quad (1)$$

$$= (Rref + Gref + Bref + Eref) - (Rd + Gd + Bd)$$

Figure 10B:
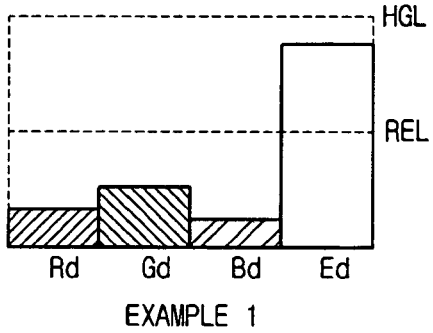
FIGS. 10B and 10C illustrate examples of interference sub-pixel data outputted from the operation unit of FIG. 9.
Figure 10C:
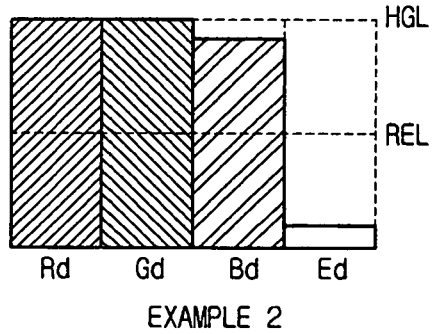

According to Equation (1), when the respective gray scale levels of the combined R, G and B sub-pixel data Rd, Gd and Bd become lower than the reference gray scale level REL and thus approach a base gray scale level (See FIG. 10B), the interference sub-pixel data Ed has a gray scale level close to the maximum gray scale level HGL. When the respective gray scale levels of the combined R, G and B sub-pixel data Rd, Gd and Bd become higher than the reference gray scale level REL and thus approach the maximum gray scale level HGL (See FIG. 10B), the interference sub-pixel data Ed has a gray scale level close to the base gray scale level.

Since the interference sub-pixel data Ed has a gray scale level contrary to those of the R, G and B sub-pixel data Rd, Gd and Bd as stated above, the luminance at the side of the color pixel PXC is distributed near a reference value (e.g., an intermediate luminance value). Since the luminance at the side of the color pixel PXC maintains the reference value, an image displayed on the liquid crystal panel 30 in the narrow viewing angle mode cannot be recognized at all from the side direction, as illustrated in FIG. 8B. Consequently, the secrecy in the narrow viewing angle mode can be further enhanced.

The operation unit 54 that calculates the interference sub-pixel data Ed may be a processor with an operation function. The operation unit 54 may be a look-up table. That is, using the combined R, G and B sub-pixel data Rd, Gd and Bd as one address, the interference sub-pixel data Ed stored at an address corresponding to the logic value of the sub-pixel data is read out from the look-up table. Every time when the R, G and B sub-pixel data Rd, Gd and Bd are received in response to the second interference control signal, the look-up table performs a read operation one time.

Depending on the logic value of the wide/narrow mode control signal W/N from the external video source, the selector 56 selects the offset sub-pixel data Eoff from the register 50 or the interference sub-pixel data Ed from the operation unit 54 as an interference data IFD, and transfers the interference data IFD to the video data combiner 42 of FIG. 7. When the wide/narrow mode control signal W/N has the specific logic level (i.e., a "high" logic level or a "low" logic level) that designates the narrow viewing angle mode, the selector 56 selects the interference sub-pixel data Ed from the operation unit 54 as an interference data IFD and transfer the interference data IFD to the video data combiner 42. When the wide/narrow mode control signal WIN has the initialization logic level (i.e., a "low" logic level or a "high" logic level) that designates the wide viewing angle mode, the selector 56 selects the offset sub-pixel data Eoff from the register 50 as an interference data IFD and transfer the interference data IFD to the video data combiner 42.

Figure 11:
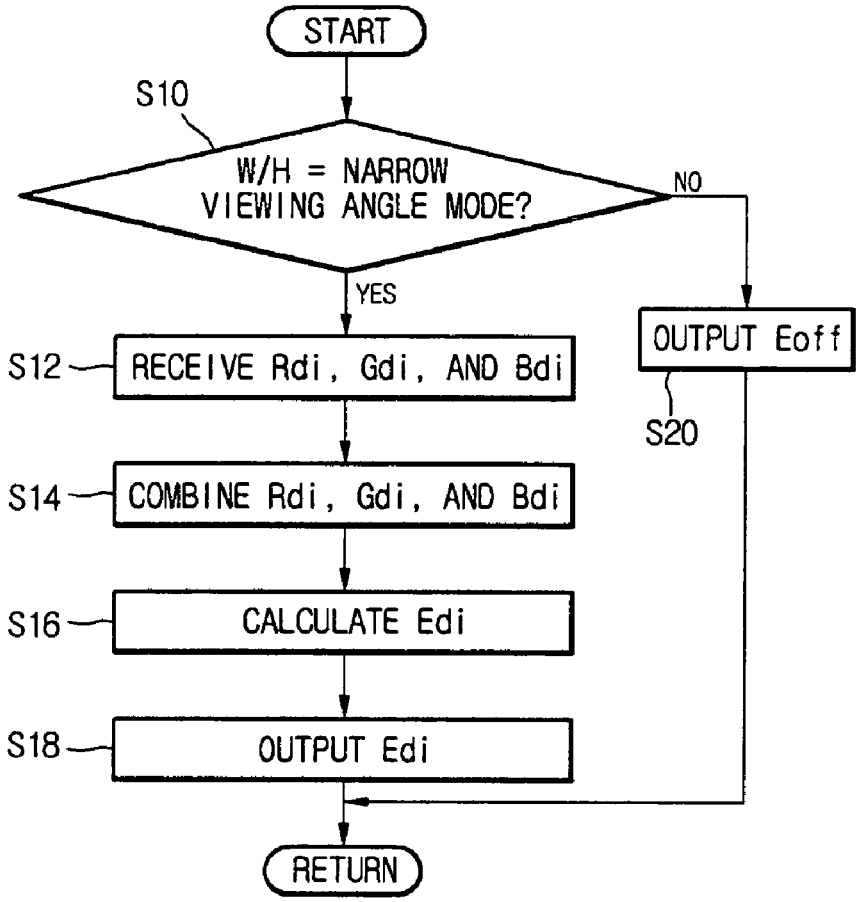
FIG. 11 is a flow diagram that illustrates an operation of the interference data generator in FIG. 9.

FIG. 11 is a flow diagram that illustrates an operation of the interference data generator 40 in FIG. 9.

Referring to FIG. 11, the interference data generator 40 determines whether the wide/narrow mode control signal WIN has the specific logic level (i.e., a "high" logic level or a "low" logic level) that designates the narrow viewing angle mode (operation S10). When the wide/narrow mode control signal W/N has the specific logic level (i.e., a "high" logic level or a "low" logic level) that designates the narrow viewing angle mode, the interference data generator 40 sequentially receives R, G and B sub-pixel data Rdi, Gdi and Bdi from the external video source (operation S12) and combines the R, G and B sub-pixel data Rdi, Gdi and Bdi (operation S14).

The interference data generator 40 calculates an interference sub-pixel data Edi by Equation (1) using the combined R, G and B sub-pixel data Rdi, Gdi and Bdi (operation S16), and selects the calculated interference sub-pixel data Edi as an interference data IFD to supply the interference data IFD to the video data combiner 42 (operation S18). When the wide/narrow mode control signal WIN has the initialization logic level (i.e., a "low" logic level or a "high" logic level) that designates the wide viewing angle mode, the interference data generator 40 selects the offset sub-pixel data Eoff as an interference data IFD and supplies the interference data IFD to the video data combiner 42 (operation S20). After operations S18 and S20, the interference data generator 40 returns to operation S10.

Figure 12:
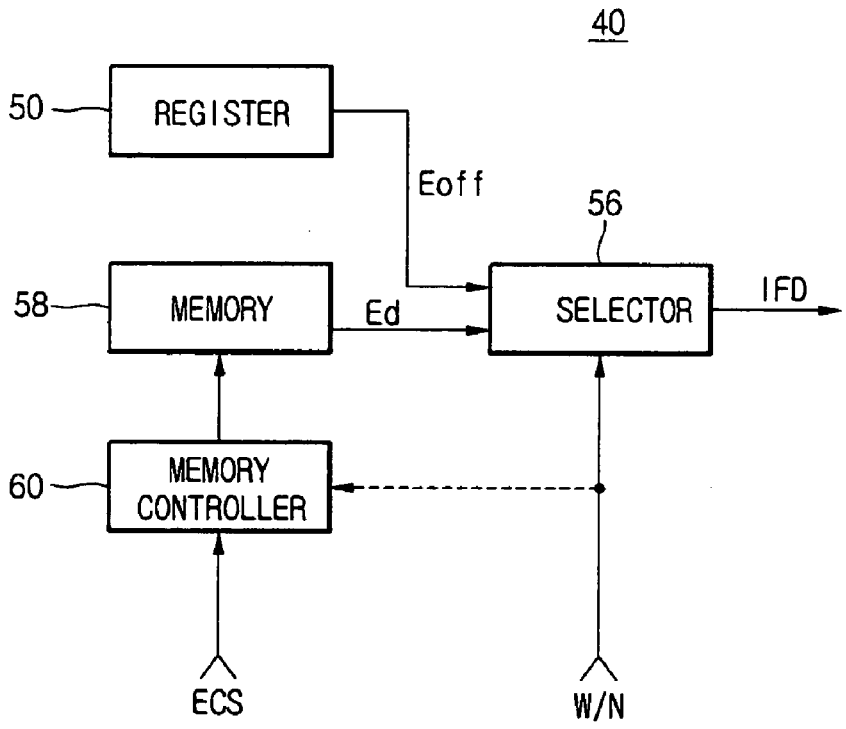
FIG. 12 is a detailed block diagram that illustrates another embodiment of an interference data generator in FIG. 7.

FIG. 12 is a detailed block diagram that illustrates another embodiment of the interference data generator 40 in FIG. 7. Unlike the interference data generator 40 of FIG. 9, the interference data generator 40 of FIG. 12 uses a memory 58 and a memory controller 60 instead of the data combiner 52 and the operation unit 54. Descriptions about the same elements as in FIG. 9 will be omitted for conciseness.

Figure 13:
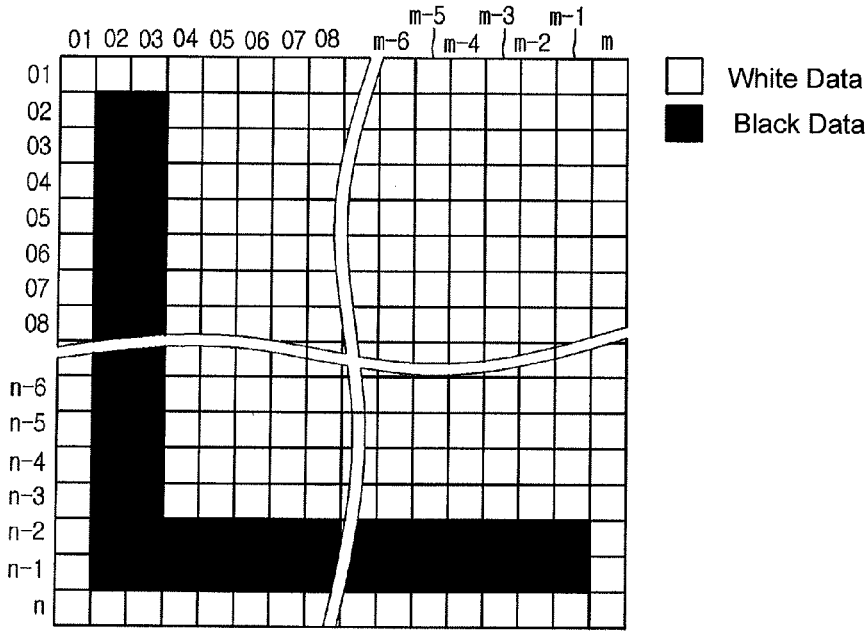
FIG. 13 illustrates an example of a memory map of a memory in FIG. 12.

Referring to FIG. 12, the memory 58 stores the interference sub-pixel data Ed corresponding to the interference sub-pixels ESP11~ESPmn on the liquid crystal panel 30. The memory 58 may be nonvolatile memory such as an ROM and an EEPROM. The ROM can retain the interference sub-pixel data Ed even when no power is supplied thereto. The EEPROM can update the interference sub-pixel data Ed, and can retain the interference sub-pixel data Ed even when no power is supplied thereto. The memory 58 that stores the interference sub-pixel data Ed with a specific interference pattern includes as many storage regions as the interference sub-pixels ESP11~ESPmn of the liquid crystal panel 30. Some of the storage regions store interference sub-pixel data with a specific gray scale level, while the other of the storage regions store interference sub-pixel data with gray scale levels lower or higher than the specific gray scale level. For example, when interference sub-pixel data Ed that form an "L"-shaped black pattern shown in FIG. 13 are stored in the memory 58, storage regions that are second and third column lines while being second to (n−1)th row lines and storage regions that are (n−2)th and (n−1)th row lines while being third to (m−1)th column lines store interference sub-pixel data Ed with a gray scale level corresponding to a black color, while the other storage regions store interference sub-pixel data Ed with a gray scale level corresponding to a white color. The memory 58 may store as many interference sub-pixel data Ed as the number of the interference sub-pixel ESP11~ESPmn that form a non-"L" shaped interference pattern.

When compared to the use of the interference sub-pixel data Ed calculated from the R, G and B sub-pixel data Rdi, Gdi and Bdi contained in the video data VD, the use of the interference sub-pixel data Ed stored in the memory 58 to form an image of a specific interference pattern simplifies a processing path of video data. Accordingly, the response speed of the video data combiner 42 can be enhanced.

The memory controller 60 controls the memory 58 using the interference control signal ECS from the timing controller 48 of FIG. 7, such that the interference sub-pixel data Ed corresponds to one image that is sequentially read out from the memory 58. The interference control signal ECS supplied to the memory controller 60 includes a read mode control signal that periodically designates a read operation period. A read clock that allows all of the interference sub-pixel data Ed to be read one time during the read operation period. The memory controller 60 may respond to the wide/narrow mode control signal WIN. The memory controller 60 performs a read operation only when the wide/narrow mode control signal W/N has a specific logic level that designates the narrow viewing angle mode, thereby preventing unnecessary power consumption.

Depending on the logic value of the wide/narrow mode control signal W/N from the external video source, the selector 56 selects the offset sub-pixel data Eoff from the register 50 or the interference sub-pixel data Ed from the memory 58 as an interference data IFD, and transfers the interference data IFD to the video data combiner 42 of FIG. 7. When the wide/narrow mode control signal W/N has the specific logic level (i.e., a "high" logic level or a "low" logic level) that designates the narrow viewing angle mode, the selector 56 selects the interference sub-pixel data Ed from the memory 58 as an interference data IFD and transfer the interference data IFD to the video data combiner 42. On the contrary, when the wide/narrow mode control signal W/N has the initialization logic level (i.e., a "low" logic level or a "high" logic level) designating the wide viewing angle mode, the selector 56 selects the offset sub-pixel data Eoff from the register 50 as an interference data IFD and transfer the interference data IFD to the video data combiner 42.

Figure 14:
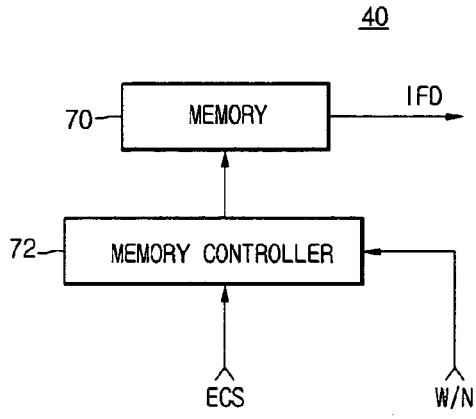
FIG. 14 is a detailed block diagram that illustrates another embodiment of an interference data generator in FIG. 7.

FIG. 14 is a detailed block diagram that illustrates an another embodiment of the interference data generator 40 in FIG. 7.

Referring to FIG. 14, the interference data generator 40 includes a memory 70 and a memory controller 72 that controls a read operation of the memory 70. The memory 70 stores as many interference sub-pixel data Ed as the number of the interference sub-pixel ESP11~ESPmn of the liquid crystal panel 30, which form an image with a specific interference pattern. An image with a specific interference pattern stored in the memory 70 can be mapped in the same manner as for an image with an interference pattern stored in the memory 58 of FIG. 12. The memory 70 stores the offset sub-pixel data Eoff that corresponds to an offset value. The memory 70 may be a nonvolatile memory such as an ROM and an EEPROM. The ROM can retain data even when no power is supplied thereto. The EEPROM can update data, and can retain data even when no power is supplied thereto. The interference sub-pixel data Ed or the offset sub-pixel data Eoff read from the memory 70 is selected as an interference data IFD, and the interference data IFD is supplied to the video data combiner 42 of FIG. 7.

The memory controller 72 controls a successive read operation of the memory 70 using the interference control signal ECS from the timing controller 48 of FIG. 7, such that the offset sub-pixel data Eoff stored in the memory 70 are repeatedly read or the interference sub-pixel data Ed that forms an image of a specific interference pattern that are sequentially read. In response to the wide/narrow mode control signal WIN, the memory controller 72 performs a control operation such that the offset sub-pixel data Eoff stored in the memory and the interference sub-pixel data Ed forms an image of a specific interference pattern that are selectively read. When the wide/narrow mode control signal WIN has a specific logic level that designates the narrow viewing angle mode, the memory controller 72 performs a control operation such that the stored interference sub-pixel data Ed forms an image of a specific interference pattern that are sequentially read out from the memory 70 and the interference data IFD that correspond to the read interference sub-pixel data Ed that are transferred to the video data combiner 42 of FIG. 7. When the wide/narrow mode control signal WIN has the initialization logic level that designates the wide viewing angle mode, the memory controller 72 performs a control operation such that the offset sub-pixel data Eoff are repeatedly read out from the memory 70 and the interference data IFD that corresponds to the read offset sub-pixel data Eoff are transferred to the video data combiner 42 of FIG. 7.

The interference data generator 40 of FIG. 14 has a simpler circuit structure than the interference data generator 40 of FIG. 12.

Figure 15:
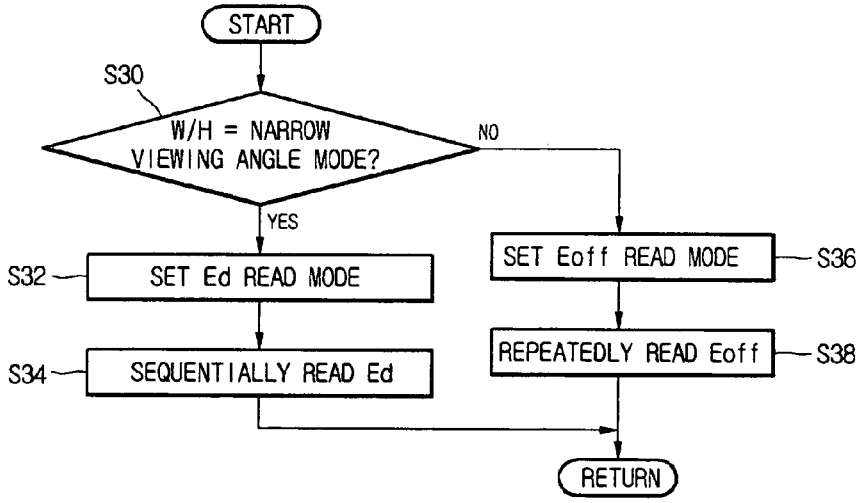
FIG. 15 is a flow diagram that illustrates an operation of a memory controller in FIG. 14.

FIG. 15 is a flow diagram that illustrates an operation of the memory controller 40 in FIG. 14.

Referring to FIG. 15, the memory controller 40 checks and determines whether the wide/narrow mode control signal WIN has a specific logic level that designates the narrow viewing angle mode or an initialization logic level that designates the wide viewing angle mode (operation S30).

When the wide/narrow mode control signal W/N has the specific logic level (e.g., a "high" logic level or a "low" logic level) that designates the narrow viewing angle mode, the memory controller 72 sets an interference sub-pixel data flag allocated to one of its resisters to "1" to set a read mode of the interference sub-pixel data Ed (operation S32). The memory controller 72 sequentially designates storage regions of the memory 70 that stores an image of a specific interference pattern, such that the interference sub-pixel data Ed forming the image of a specific interference pattern are sequentially read (operation S34). These sequentially-read interference sub-pixel data Ed, which are determined to be the interference data IFD, are supplied to the video data combiner 42 of FIG. 7.

On the contrary, when the initialization logic level (e.g., a "low" logic level or a "high" logic level) that designate the wide viewing angle mode, the memory controller 72 resets an interference sub-pixel data flag that is allocated to one of its resisters to "0" to set a read mode of the offset sub-pixel data Eoff (operation S36). The memory controller 72 repeatedly designates storage regions of the memory 70 that stores the offset sub-pixel data Eoff, such that the offset sub-pixel data Eoff are repeatedly read (operation S38). These sequentially-read the offset sub-pixel data Eoff, which are determined to be the interference data IFD, are supplied to the video data combiner 42 of FIG. 7.

Figure 16:
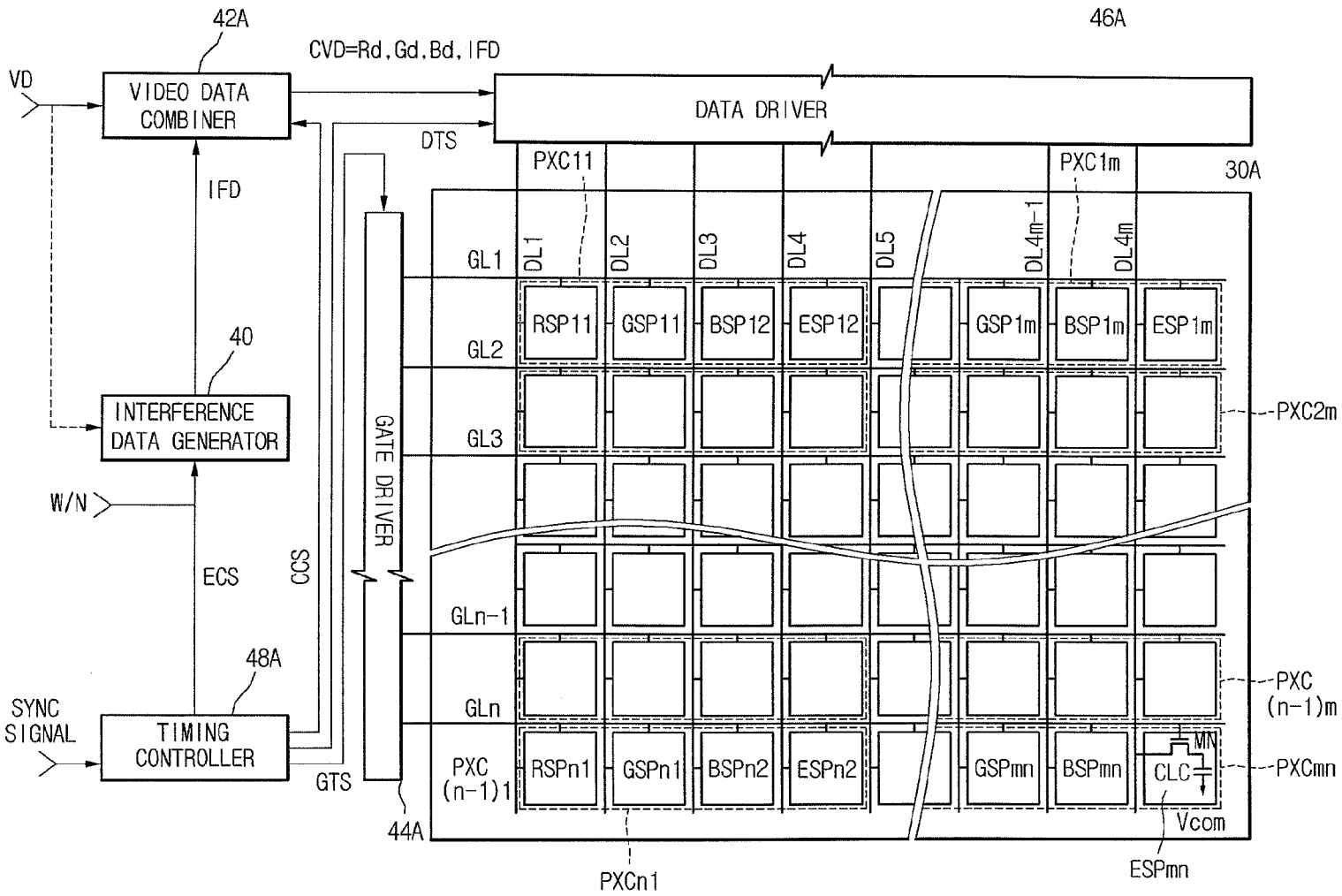
FIG. 16 is a block diagram of an LCD that limits a viewing angle according to another embodiment.

FIG. 16 is a block diagram of an LCD that limits the viewing angle according to another embodiment.

Referring to FIG. 16, an LCD according to another embodiment includes a liquid crystal panel 30A. A interference data generator 40 generates interference data IFD to be supplied to the interference sub-pixels ESP11~ESPmn on the liquid crystal panel 30. A video data combiner 42A adds the interference data IFD to external video data VD. As illustrated in FIG. 4, the liquid crystal panel 30A includes m×n number of color pixels PXC11~PXCmn that include the red (R) sub-pixels RSP11~RSPmn connected to the (4k−3)th data lines DL1~DL4m−3. The green (G) sub-pixels GSP11~GSPmn are connected to (4k−2)th data lines DL2~DL4m−2. The blue (B) sub-pixels BSP11~BSPmn are connected to (4k−1)th data lines DL3~DL4m−1. The interference sub-pixels ESP11~ESPmn are connected to (4k)th data lines DL4~DL4m.

In response to a wide/narrow mode control signal W/N from an external video source (e.g. a graphic card of a computer), the interference data generator 40 supplies the interference data IFD for switching W/N modes of a viewing angle of the liquid crystal panel 30A to the video data combiner 42A. When the wide/narrow mode control signal W/N has a specific logic level (e.g., a "high" logic level or a "low" logic level) that designates a narrow viewing angle mode, the interference data IFD includes interference (E) sub-pixel data Ed that forms an image of a fixed interference pattern, which allows interference light to be added in the both side directions with respect to the front direction of the liquid crystal panel 30A. The interference data IFD may include interference sub-pixel data Ed that forms an interference pattern that varies per image. The interference data generator 40 may receive the external video data VD from the external video source (e.g., a graphic card of a computer) that generates the interference data IFD with the interference pattern that varies per image. When the wide/narrow mode control signal W/N has an initialization logic level (e.g., a "low" logic level or a "high" logic level) that designates a wide viewing angle mode, the interference data IFD includes offset sub-pixel data Eoff with an offset value, which prevents interference light from traveling in the both side directions with respect to the front direction of the liquid crystal panel 30A.

The video data combiner 42A receives a video data VD that includes color sub-pixel data for the R, G and B sub-pixels RSP, GSP and BSP from the external video source (not illustrated). The video data combiner 42A adds the interference data IFD from the interference data generator 40 to the video data VD. The video data combiner 42A rearranges the R, G, B and E (or offset) sub-pixel data Rd, Gd, Bd and IFD (i.e., Ed or Eoff) in accordance with the arrangement state of the sub-pixels on the liquid crystal panel 30A, thereby generating combined video data CVD.

The LCD according to another embodiment includes a gate driver 44A that sequentially drives the gate lines GL1~GLn of the liquid crystal panel 30A. A data driver 46A sequentially drives the data lines DL1~DL4m of the liquid crystal panel 30A. A timing controller 48A controls the operation timing of the gate and data drivers 44A and 46A. In response to a gate timing signal GTS from the timing controller 48A, the gate driver 44A generates n number of scan signals that sequentially enables the gate lines GL1~GLn.

In response to a data timing signal DTS from the timing controller 48A, the data driver 46A supplies sub-pixel that drives signals to 4m number of data lines DL1~LL4m every time when any one of the gate lines GL1~GLn is enabled. To this end, the data driver 46A receives the combined video data CVD that is serially transferred from the video data combiner 42A. Whenever any one of the gate lines GL1~GLn are enabled, the data driver 46A receives sub-pixel data streams in which R, G, B and E (or offset) sub-pixel data Rd, Gd, Bd, IFD (Ed or Eoff) are arranged sequentially and alternately, such that the R sub-pixel data stream, the G sub-pixel data stream, the B sub-pixel data stream, and the E (or offset) sub-pixel data stream are applied to the (4k−3)th data lines DL1~DL4m−3, the (4k−2)th data lines DL2~DL4m−2, the (4k−1)th data lines DL3~DL4m−1, and the (4k)th data lines DL~DL4m, respectively.

When the wide/narrow mode control signal W/N has the specific logic level that designates the narrow viewing angle mode, the interference sub-pixel driving signal has a voltage level that allows the interference sub-pixel ESP to transmit interference light in both side directions with respect to the front direction of the liquid crystal panel 30A. The quantity of this interference light is adjusted according to the voltage level of the interference sub-pixel driving signal. This quantity of the interference light is added to the quantity of light that travels through the R, G and B sub-pixels RSP, GSP and BSP in the both side directions, such that luminance components at the both sides interfere with each other. As illustrated in FIG. 8B, an image that cannot be viewed in the side direction is displayed on the liquid crystal panel 30A. The interference sub-pixel that drives signals have different voltage levels at positions of the interference sub-pixels ESP11~ESPmn, and thus the color pixels PXC have different interference amounts of luminance. An image displayed on the liquid crystal panel 30A cannot be recognized at all in the both side directions. Consequently, the secrecy in the narrow viewing angle mode is further enhanced.

When the wide/narrow mode control signal W/N has the initialization logic level that designates the wide viewing angle mode, the interference sub-pixel ESP responds to an offset sub-pixel driving signal with an offset voltage level that prevents interference light from traveling in the front and both side directions of the liquid crystal panel 30A. Due to this offset sub-pixel driving signal, there only exists light that travels through the R, G and B sub-pixels in the front and both side directions of the liquid crystal panel 30A. As illustrated in FIG. 8A, an image displayed on the liquid crystal panel 30A can be viewed in the side direction as well as the front direction.

The timing controller 48A receives sync signals (i.e., vertical and horizontal sync signals and a data clock) from the external video source. Using the sync signals, the timing controller 48A generates the gate timing signal GTS to be supplied to the gate driver 44A the data timing signal DTS to be supplied to the data driver 46A. The timing controller 48A generates an interference control signal ECS that controls the data generating operation of the interference data generator 40 and a combination control signal CCS that controls the data combining operation of the video data combiner 42A.

As described above, the liquid crystal panel includes the interference sub-pixels as well as the color sub-pixels, thereby limiting the viewing angle thereof. Since the interference sub-pixels and the color sub-pixels are disposed on the same plane or on the same layer, the thickness and weight of the liquid crystal panel do not increase. The viewing angle can be controlled by only one liquid crystal layer, and the decrease of the light quantity and the degradation of the brightness can be prevented.

The interference sub-pixels are driven by the interference sub-pixel data that form an image with an interference pattern. An image to be viewed in the side direction of the liquid crystal panel is changed. Consequently, the LCD according makes it possible to enhance the secrecy of a user thereof.

It will be apparent to those skilled in the art that various modifications and variations can be made in light of the description above. Thus, it is intended that the description cover the modifications and variations of this invention provided they come within the scope of the appended claims and their equivalents.

What is claimed is:

1. A liquid crystal panel comprising:

a plurality of color pixels each including red (R), green (G) and blue (B) sub-pixels; and a plurality of interference (E) sub-pixels included in each of the color pixels and disposed on either the same plane or layer as the color pixels, a data driver supplying pixel driving signals to the sub-pixels of the liquid crystal panel by one line;

an interference data generator generating interference data that is supplied to the interference sub-pixels; and a video data combiner inserting the interference data to video data supplied to the data driver, wherein the plurality of interference (E) sub-pixels limit light that penetrates the liquid crystal panel and travels in the side directions of the liquid crystal panel, wherein the R, G and B sub-pixels are driven by a horizontal electric field and the interference sub-pixels are driven by a vertical electric field, and wherein the interference data includes offset sub-pixel data supplied to the interference sub-pixels for a wide viewing angle mode and interference sub-pixel data supplied to the interference sub-pixels for a narrow viewing angle mode.

2. The liquid crystal panel according to claim 1, wherein the sub-pixels in each of the color pixels are connected to a pair of gate lines and a pair of data lines.

3. The liquid crystal panel according to claim 2, wherein the R, G and B sub-pixels are driven by a horizontal electric field and the interference sub-pixels are driven by a vertical electric field.

4. The liquid crystal panel according to claim 2, wherein each of the R, G and B sub-pixels includes at least one or more band-shaped common electrodes that alternate with at least one or more band-shaped pixel electrodes; and wherein each of the interference sub-pixels includes a plate-shaped pixel electrode and a plate-shaped common electrode that face each other.

5. The liquid crystal panel according to claim 1, wherein the sub-pixels in each of the color pixels are connected commonly to one gate line and connected respectively to four data lines.

6. The liquid crystal panel according to claim 5, wherein the R, G and B sub-pixels are driven by a horizontal electric field and the interference sub-pixels are driven by a vertical electric field.

7. The liquid crystal panel according to claim 5, wherein each of the R, G and B sub-pixels includes at least one or more band-shaped common electrodes that alternate with at least one or more band-shaped pixel electrodes; and wherein each of the interference sub-pixels includes a plate-shaped pixel electrode and a plate-shaped common electrode that face each other.

8. The LCD according to claim 1, wherein the interference data generator comprises:

a memory storing interference sub-pixel data of an image with an interference pattern; and a memory controller controlling a read operation of the memory.

9. The LCD according to claim 8, wherein the interference data generator further comprises:

an offset sub-pixel data generator generating offset sub-pixel data with a logic value that corresponds to an offset voltage; and a selector transferring selectively the offset sub-pixel data from the offset sub-pixel data generator and the interference sub-pixel data from the memory to the video data combiner in response to a wide/narrow mode control signal.

10. The LCD according to claim 9, wherein the offset sub-pixel data generator includes either a register or a switch.

11. The LCD according to claim 8, wherein the memory further stores offset sub-pixel data with a logic value corresponding to an offset voltage; and wherein the memory controller operates the memory according to a wide/narrow mode control signal such that the offset sub-pixel data and the interference sub-pixel data stored in the memory are selectively read and transmitted to the video data combiner.

12. The LCD according to claim 1, wherein the interference data generator comprises:

a data combiner combining R, G and B sub-pixel data contained in the video data; and an operation unit operating interference sub-pixel data on the basis of the combined sub-pixel data and supplying the calculated interference sub-pixel data to the video data combiner.

13. The LCD according to claim 12, wherein the operation unit performs an operation such that a luminance value of the interference sub-pixel data is distributed at a reference gray scale level.

14. The LCD according to claim 12, wherein the interference data generator further comprises:

an offset sub-pixel data generator generating offset sub-pixel data with a logic value corresponding to an offset voltage; and a selector transferring selectively the offset sub-pixel data from the offset sub-pixel data generator and the interference sub-pixel data from the operation unit to the video data combiner in response to a wide/narrow mode control signal.

15. The liquid crystal panel according to claim 12, wherein the operation unit operates the interference sub-pixel data by setting the sum of R, G, B and E sub-pixel data with a gray scale level lower than the maximum gray scale level to a reference luminance data and subtracting the sum of the combined R, G and B sub-pixel data from the data combiner from the reference luminance data.

16. The LCD according to claim 15, wherein the operation unit comprises a processor performing an operation on the interference sub-pixel data using the combined R, G and B sub-pixel data from the data combiner.

17. The LCD according to claim 12, wherein the operation unit comprises a look-up table configured to supply the interference sub-pixel data to the video data combiner using the combined R, G and B sub-pixel data from the data combiner.

18. The LCD according to any one of claim 17, wherein the interference data generator further comprises:

an offset sub-pixel data generator generating offset sub-pixel data with a logic value corresponding to an offset voltage; and a selector transferring selectively the offset sub-pixel data from the offset sub-pixel data generator and the interference sub-pixel data from the look-up table to the video data combiner in response to a wide/narrow mode control signal.

19. The LCD according to claim 18, wherein the offset sub-pixel data generator includes either a register or a switch.

* * * * *